United States Patent [19]

Karch, deceased

[11] 3,931,767

[45] Jan. 13, 1976

[54] MAGNETIC SUSPENSION RAILWAY

[75] Inventor: Ludwig Karch, deceased, late of Munich, Germany, by Hermine Karch, administratrix

[73] Assignee: Messerschmitt-Bolkow-Blohm GmbH, Germany

[22] Filed: Feb. 28, 1974

[21] Appl. No.: 446,759

[30] Foreign Application Priority Data

Mar. 3, 1973 Germany ..... 2310718

[52] U.S. Cl. ..... 104/130; 104/148 MS

[51] Int. Cl.[2] ..... E01B 25/06

[58] Field of Search ..... 104/148 MS, 148 LM, 148 SS, 104/130, 134, 96, 23 FS

[56] References Cited

UNITED STATES PATENTS

| | | | |
|---|---|---|---|
| 3,797,402 | 3/1974 | Karch | 104/148 MS |
| 3,842,747 | 10/1974 | Schwarzler | 104/148 MS |
| 3,845,720 | 11/1974 | Bohn | 104/148 MS |
| 3,847,086 | 11/1974 | Steenbeck | 104/148 MS |

FOREIGN PATENTS OR APPLICATIONS

| | | | |
|---|---|---|---|
| 707,032 | 5/1941 | Germany | 104/148 MS |

*Primary Examiner*—Trygve M. Blix
*Assistant Examiner*—Reinhard J. Eisenzopf
*Attorney, Agent, or Firm*—Toren, McGeady and Stanger

[57] ABSTRACT

In the magnetic suspension railway disclosed, electrically-controlled carrier magnets, located on opposite sides under a railway car and coupled to two stationary magnetic carrier rails levitate the car. Electrically controlled, guide magnets, fixed under the car on both sides, guide the car between magnetic guide rails. The carrier and guide magnets for each side of the car are mounted on two mounts extending longitudinally underneath the car and facing the support and guide rails. Guiding the car onto one path or the other through a switch area at a fork is accomplished by deactivating only the guide magnets on one side of the car. At the switch area fixed support magnets in one of two rows between the rails appear above the one of an auxiliary rail projecting from the mount holding the deactivated guide magnet. The auxiliary rail is displaced from the vertical relative to the electromagnetic row into a magnetically asymmetrical position. This produces a lateral force counteracting the excess force produced by the still activated guide magnet.

13 Claims, 5 Drawing Figures

MAGNETIC SUSPENSION RAILWAY

REFERENCE TO COPENDING APPLICATIONS

This application is related to U.S. application Ser. No. 206,091, filed Dec. 8. 1971, and assigned to the same assignee, and now U.S. Pat. No. 3,820,470.

This invention relates to railroads and particularly to magnetic suspension railways.

In such railways, electrically-controlled carrier magnets on two sides underneath a railway car suspend the car relative to two magnetic support rails. Electrically controlled, guide magnets fixed under both sides of the car guide the car along magnetic guide rails. The carrier and guide magnets for each side of a car appear on two mounts extending longitudinally underneath the car and facing the carrier and guide rails. Guiding or passing a car through a switch is accomplished by deactivating the guide magnets on one side of the car.

Such railway systems introduce a number of problems in controlling the car as it passes through a switch area. German Pat. publication OS 2,021,834 and German Pat. No. 707,032 attempt to deal with these problems.

A substantial disadvantage of the above and other known systems arises because, within the switch area, the maximum force that a given current can achieve is less than would be available at other places along the track. This creates the risk that forces produced by sudden air gusts acting on the car be sufficient to decouple the carrier magnets magnetically from the carrier rail. At the least, considerable disturbance of the carrier system, and thus the guidance of the car, can be expected. Strengthening the carrier magnets to an extent greater than that necessary for levitating the car outside the switch area, that is along the free track, undesirably increases the net weight of the cars. For well-known reasons, it is necessary narrowly to limit the deflection of carrier magnets in known guidance systems relative to their supports, so that only small lateral forces can be produced with these support magnets.

According to a feature of the invention, each mount carries a support or auxiliary magnetic rail on its elongated side remote from the carrier and guide rails. Within a switch area the auxiliary rail, on the mount whose guide magnets are deactivated, passes by a row of electromagnetic support magnets which uphold the auxiliary rail and that side of the car. The activated guide magnets and the positions of the elements offset the auxiliary from the vertical and produce a magnetic asymmetry which generates a lateral force that centers the car.

In such an arrangement, a force counteracting the attraction of the respective energized guide magnets is produced by means of support rails in the car and stationary support magnets, hence by means of those magnets which conserve the double function of support and guidance, without changing the net weight of the cars. Accordingly, the magnetically asymmetrical displacement, that is, the deflection of the rails of the cars relative to the corresponding row of stationary support magnets can be relatively greater. This makes possible a considerable increase in the gradient of the lateral forces produced by the support magnets as compared to known systems.

According to another feature of the invention, the support magnets in the switch area are displaced laterally to the outside relative to the nearby carrier or guide rail into a magnetically asymmetric position so that the magnets opposing each other in pairs are arranged symmetrically relative to the longitudinal car axis.

This furnishes an increase of the gradient of the lateral forces while maintaining a relatively small deflection of the rails of the cars with respect to the row of stationary support magnets. In this case, the force counteracting the attraction of the respective energized guide magnet is a summation force of the lateral force of the stationary support magnets and the lateral force of the respective support magnets of the car. Accordingly the deflection of the support magnets of the car with respect to the stationary supporting rail, if such a deflection is to be provided, can be substantially smaller than in known arrangements.

By virtue of the invention, a force counteracting the attraction of the respective energized guide magnets can be produced in the switch range of a magnetic suspension railway of the above-described type by means provided primarily for the support of the cars, without having to make the support magnets of the car stronger. The gradient of this force is selected to be much greater than is possible, for example, with known guidance systems.

These and other features of the invention are pointed out in the claims. Other objects and advantages of the invention will become evident from the following detailed description when read in light of the accompanying drawings.

Figure 1:
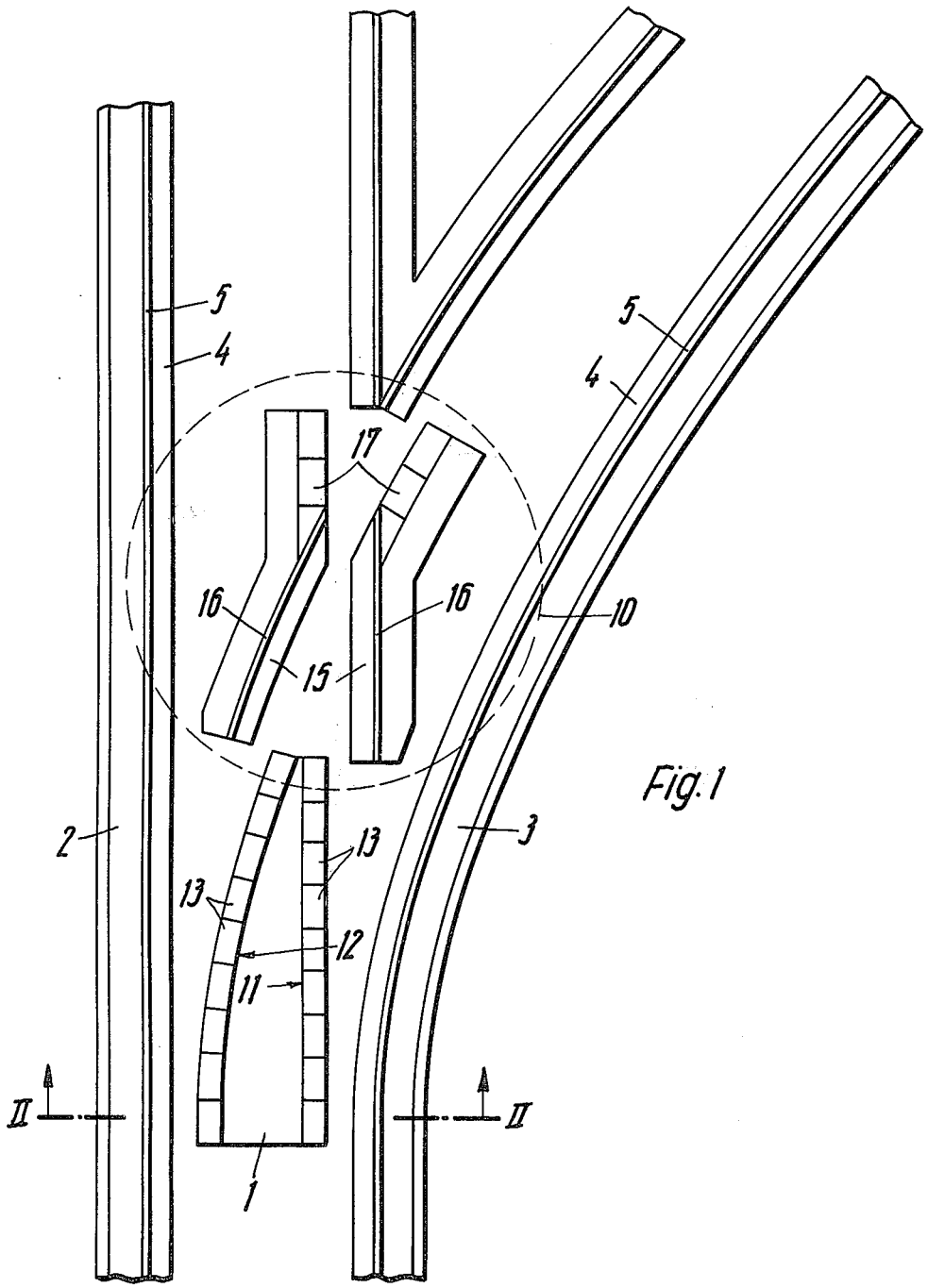
FIG. 1 is a plan view of an arrangement of carrier and guide rails as well as of rows of support magnets in connection with respective girders in the range of a switch forming a system embodying features of the invention.
Figure 2:
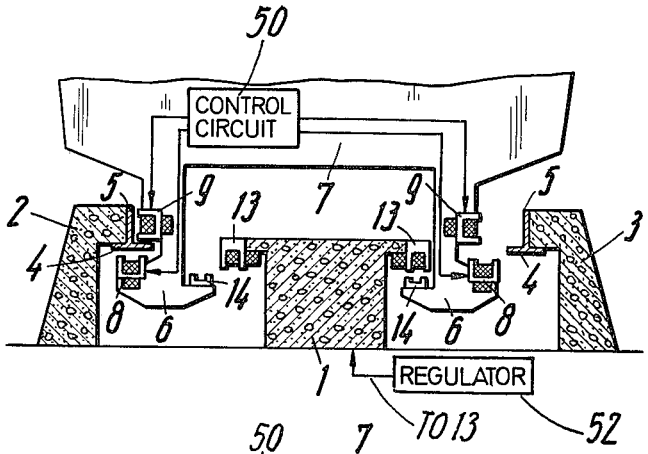
FIG. 2 shows an enlarged scale of a section through the switch arrangement along the line II—II of FIG. 1 as well as the supporting guide elements of a car passing through this point according to one embodiment of the invention.
Figure 3:
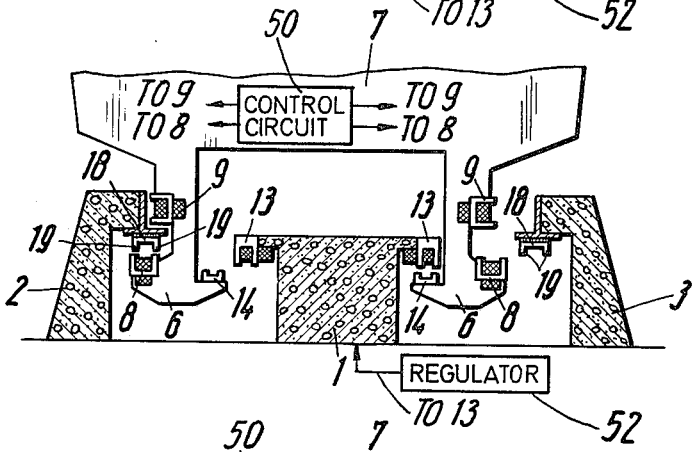
Figure 4:
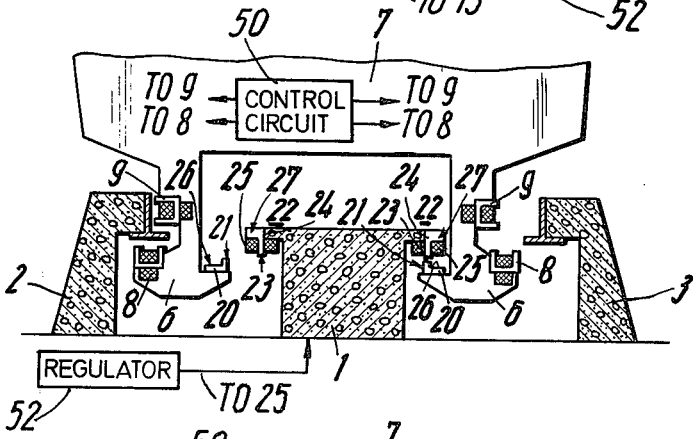
Figure 5:
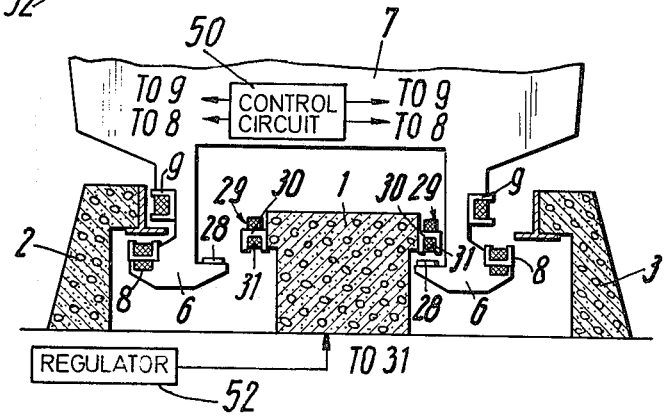

FIGS. 3 to 5, like FIG. 2, show additional switch arrangements which differ from that of FIG. 1 and constitute still other embodiments of the invention.

In FIG. 1, a unilaterally tapering support beam 1 of a switch of a car-straddling magnetic suspension railway, lies between two rail holders 2 and 3. The latter extend over the entire switch range and hold magnetic (magnetically conductive) carrier and guide rails 4 and 5. The latter serve as armatures for carrier and guide magnets 8 and 9 respectively arranged on mounts 6 of a car 7 as shown in FIG. 2. The support beam 1 starts at the head of the switch and projects into the heart of the switch defined by the phantom circle 10. The straight flank or portion 11 of the support beam 1 extends parallel to the straight holder 2 associated with the continuous or straight roadway. The curved portion or flank 12 of the support beam 1 extends parallel to the holder 3 of the branch roadway. The holder 3 follows the curvature of the switch. A row of support magnets 13 are mounted on each flank 11 and 12 of the support beam 1. Magnetic rails 14 arranged on the mount 6 of the car 7 serve as armatures for the support magnets 13.

The distance between the straight holder 2 and the straight flank 11 of the support beam 1 is such that straight travel of the car 7 within the switch area causes the rail 14 on the right mount 6 to lie under the support magnet 13 of the straight flank of the right mount's carrier and guide magnets 8 and 9 opposite the corresponding carrier and guide rails 4 and 5 of the curved holder 3 are in an inoperative position. As shown in FIG. 2, only the carrier and guide magnets 8 and 9 of the car 7 on the left mount 6 can exert an attractive force upon the corresponding carrier and guide rails 4 and 5 on the straight holder 2.

In order to maintain the suspension of the car 7 on the right side as well, and at the same time to guide the car laterally, the right mount's rail 14 has its operating position displaced into a magnetically unsymmetrical position relative to the support magnet 13 of the straight flank 11 of the support beam 1. This asymmetry is in the direction of the straight holder 2. The stationary support magnets 13 thus exert not only car-supporting vertical attractive forces on the rail 14, but also lateral restoring forces which attempt to displace the car to the right against the action of the left mount's 6 guide magnets 9. These restoring forces maintain a nominal distance between the magnets 9 of the left mount 6 and the corresponding guide rail 5 of the straight girder 2. Conventional control circuits regulate the excitation of the support and magnets 8 and 9 of the car 7, as well as the stationary support magnets 13 to maintain these magnets a nominal distance from their respective rails. Preferably, only the guide magnets 9 regulate the lateral guidance of the car 7.

The position shown in FIG. 2 for the car 7 concerns only that assumed by the car while it is riding without change of direction. The support and guidance system of the car 7 changes the direction of the car along the curved track in the same manner. In this case, the respective carrier and guide magnets 8 and 9 of the right mount 6 move toward the carrier and guide rail 4 and 5 of the curved holder 3. The stationary support magnets 13 of the curved flank 12 on the support beam 1 coact with the rail 14 on the left mount 6.

As can be seen from FIG. 1, when the cars proceed along a straight track, the carrier and guide magnets 8 and 9 of the right mount 6 briefly enter into the action at the end of the support beam in the heart 10 of the switch, where rows of the support magnets 13 must necessarily be interrupted, opposite respective carrier and guide rails 15 and 16 extending parallel to the straight flank 11 of the support beam 1. During movement along the curved track, the support and guide magnets 8 and 9 of the left mount 6 briefly enter into the action at the end of the support beam 1 in the heart 10 of the switch opposite carrier and guide rails 15 and 16 extending parallel to the curved flank 12 of the support beam 1. After it passes the carrier and guide rails 15 and 16, the rail 14 of the right or left mount 6 again passes under a row of stationary support magnets 17. At the end of these support magnets 17, which are aligned with the corresponding magnets of the support beam 1, passage of the car through the switch is finally completed. Thus, the carrier and guide magnets 8 and 9 of both mounts 6 on both car sides can resume their support and guidance function in connection with the carrier and guide rails 4 and 5.

According to another embodiment of the invention, the carrier magnets 8 of the mounts 6 are displaced laterally relative to a carrier rail 18 to increase the gradient of the lateral restoring forces counteracting the guide magnets 9 in the switch arrangement of the above-described type. The lateral displacement corresponds to the increase. In contrast to the arrangement in FIG. 2, the support rails 18 are U-shaped, so that the magnetic force is concentrated in the region of their poles. This embodiment is shown in FIG. 3.

In the switch arrangement of FIGS. 1 to 3, U-shaped rails are provided for the mounts 6 of the car 7. In contrast, the mounts 6 of the car 7 of FIG. 4 each have a rail 20 in the form of an angle section, hence have only one pole. Stationary support magnets 22 likewise have only one pole 23 and one core 24 in the form of an angle section. The pole 23 carries a magnet coil 25. Two other sides 26 and 27 of the rails 20 and the cores 24 of the respective stationary support magnets 22 are arranged parallel to each other. In this embodiment, the magnetic flux of the rails 20 and support magnets 22 is concentrated at the two poles 21 and 23. This results in an increase in the gradient of the restoring forces.

According to another embodiment the mounts 6 of the car 7 have a flat rail 28 as shown in FIG. 5. In a corresponding stationary support magnet 29, a magnet back 30 carries a magnetic coil 31.

According to an embodiment of the invention, a linear motor, preferably one with two translators arranged on both sides of the car, and having stators secured on the holders 2 and 3, drives the car 7. Suitable third rails arranged, if necessary, on the holders 2 and 3 supply power to the car 7.

For purposes of convenience and clarity, the switch in FIG. 1 has been shown to have a substantially smaller length than is actually the case.

In operation a power control circuit 50 on the car 1 energizes the magnets 8 and 9 and controls the current passed to them. A regulator 52 mounted on or near the beam 1 energizes the coils of magnet 13 in FIG. 3 and the coils 25 and 31 in FIGS. 4 and 5. The energization is established to provide the lifting and guiding forces for these magnets and coils.

While embodiments of the invention have been described in detail and will be evident to those skilled in the art that the invention may be embodied otherwise without departing from its spirit and scope.

The embodiments of the invention in which an exclusive property or privilege is claimed are defined as follows:

1. A magnetic suspension railway, comprising a car having a horizontal longitudinal axis, a plurality of electrically controlled car carrier magnets, a plurality of electrically-controlled car guide magnets, a plurality of fixed magnetizable track rails, holding means mounted under the car and spaced interiorly of the track rails relative to the axis for holding said car carrier magnets in a suspended position vertically relative to the rails and holding the guide magnets in positions laterally between the rails, said rails branching into two paths at a branch section, said car guide magnets being distributed on opposite sides of the axis, circuit means in the car coupled to said magnets for energizing the magnets to suspend the car and guide the car over the rails and for deenergizing the guide magnets on one side of the car relative to the guide magnets on the other side of the car within the switch section so as to guide the car in the switch section onto one path and away from the other, two switch rails mounted on said holding means at a portion away from the track rails and in the direction of the axis and on opposite sides of the axis, two rows of electrically controlled switch magnets stationarily mounted in the switch area, one of said rows following one of the paths and the other of said rows following the other of the paths, said switch rails and said rows being positioned so that when the car passes through the switch section one of said switch rails and said switch magnets in one row are magnetically coupled sufficiently to support magnetically at least one side of the car while the carrier-magnets on that side are disengaged from the track rails in the switch area, said one switch rail and said one row being sufficiently offset horizontally from a magnetic symmetry so that said switch magnets impart a lateral force upon the switch rail to compensate for the magnetic disengagement of the carrier magnets on the one side of the car from the track rail on the one side of the car.

2. A railway as in claim 1, wherein the one of the rows of switch magnets is horizontally displaced from a vertical relationship with the one switch rail.

3. A railway as in claim 2, wherein the one switch rail is located beneath the one of the row of switch magnets.

4. A railway as in claim 3, wherein when the car passes through the switch section and the carrier magnets on the other side of the axis are normally positioned in magnetic engagement with one of the track rails the carrier magnet is magnetically offset from the one of the track rails in the same direction as the switch rail is from the switch magnet.

5. A railway as in claim 1, wherein said track rails are spaced to allow passage of the carrier magnets on both sides of the car between them, said holding means including a pair of members depending from the car in spaced relationship parallel to the axis of the car, each of the members carrying outwardly facing guide magnets and upwardly facing carrier magnets, said switch rails extending longitudinally along the members facing upwardly and positioned to be closer to the car axis than the carrier magnets, said switch magnets being positioned above said switch rails when the car passes through the switch section.

6. A railway as in claim 5, wherein the car passes through the switch section and the guide magnets on one side of the axis are normally positioned in magnetic engagement with one of the track, the carrier magnet is magnetically offset from the last mentioned track rail toward the same direction as the switch rail away from the axis, the carrier magnets of both members being arranged opposite each other in pairs and symmetrically with regard to the car axis.

7. A railway as in claim 5, wherein each switch magnet includes a right angle shaped core having one arm facing downwardly to form a pole opposite the switch rail and having another arm extending horizontally parallel to the switch rail.

8. A railway as in claim 7, wherein the switch rails are formed in the shape of an angle having a vertical arm extending upwardly toward the switch magnets when the car passes through the switch section and having a second arm extending horizontally.

9. A railway as in claim 5, wherein the switch rails are formed in the shape of an angle having a vertical arm extending upwardly toward the switch magnets when the car passes through the switch section and having a second arm extending horizontally.

10. An apparatus as in claim 5, wherein the switch rails include a flat narrow plate and the switch magnets include an extended longitudinal inverted U-shape.

11. A railway as in claim 5, wherein said switch rails include U-shaped rail members and wherein said switch magnets include longitudinally extending inverted U-shaped cores.

12. A railway as in claim 5, wherein each of said track rails includes an inverted T-shaped longitudinally extending rail having an upright portion for magnetically coupling with said car guiding travel magnets and horizontal portion for magnetically coupling with said carrier magnets.

13. A railway as in claim 1, wherein said switch rails each have a longitudinal direction and are, transverse to their longitudinal direction, longer horizontally than vertically.

* * * * *